United States Patent [19]

Strasser

[11] Patent Number: 4,967,572

[45] Date of Patent: Nov. 6, 1990

[54] COMPRESSOR ASSEMBLY FOR SUPPLYING HELIUM TO A CRYO-REFRIGERATOR

[75] Inventor: Wilhelm Strasser, Bergisch Gladbach, Fed. Rep. of Germany

[73] Assignee: Leybold Aktiengesellschaft, Fed. Rep. of Germany

[21] Appl. No.: 392,839

[22] Filed: Aug. 11, 1989

[30] Foreign Application Priority Data

Aug. 11, 1988 [EP] European Pat. Off. ..... 88113059

[51] Int. Cl.[5] ..... F25B 9/14

[52] U.S. Cl. ..... 62/467; 62/6

[58] Field of Search ..... 62/6, 298, 299, 467

[56] References Cited

U.S. PATENT DOCUMENTS

| | | | |
|---|---|---|---|
| 2,100,716 | 11/1937 | Lipman | 230/207 |
| 3,353,370 | 11/1967 | Patten et al. | 62/514 |
| 3,507,322 | 4/1970 | Tetrick et al. | 62/299 |
| 3,740,964 | 6/1973 | Herweg | 62/448 |
| 4,799,359 | 1/1989 | Nicoll | 62/6 |
| 4,831,828 | 5/1989 | Klusmier et al. | 62/6 |

FOREIGN PATENT DOCUMENTS

| | | |
|---|---|---|
| 3028217 | 2/1982 | Fed. Rep. of Germany . |
| 3201496 | 7/1983 | Fed. Rep. of Germany . |
| 2206485 | 7/1974 | France . |

*Primary Examiner*—Ronald C. Capossela

*Attorney, Agent, or Firm*—Hill, Van Santen, Steadman & Simpson

[57] ABSTRACT

The invention refers to an air-cooled compressor assembly for supplying a cryo-refrigerator with helium. The assembly includes a first cooler through which compressed helium flows, another cooler through which operating oil for the compressor flows, and a ventilator. It is suggested that the coolers for helium and oil are located in a separate housing, that the cooler for the helium is positioned upstream of the oil cooler with respect to the air stream generated by the ventilator, and that the compressor housing and the cooler housing are connected with each other via flexible lines.

10 Claims, 1 Drawing Sheet

COMPRESSOR ASSEMBLY FOR SUPPLYING HELIUM TO A CRYO-REFRIGERATOR

TECHNICAL FIELD

This invention relates to a compressor assembly for supplying helium to a cryo-refrigerator, where the compressor assembly includes a helium cooler, an oil cooler, and a ventilator.

BACKGROUND ART

Cryo-refrigerators are low-temperature refrigerating machines in which thermodynamic cyclic processes take place (see e.g. U.S. Pat. No. 2,906,101). A single-stage cryo-refrigerator usually includes a compressor, connectlng lines, and a cold head with a displacer and a chamber. During operation, the chamber is connected alternatingly with a high-pressure-and a low-pressure helium source, so that during reciprocation of the displacer, a thermo-dynamic cyclic process (Stirling-process, Gifford/Mc Mahon-process etc.) takes place, whereby the operating gas is carried in a closed cycle. The consequence ls that heat is eliminated in a certain region of the chamber. With a two-stage refrigerator of this kind temperatures below LO K can be reached.

One essential unit for such a refrigerator is the compressor, in which the helium, having expanded in the refrigerator, is compressed again, i.e. from approx. 7 bar (low pressure) to approx. 22 bar (high pressure). Almost all of the energy expended to accomplish this compression is converted into heat energy. Approximately 25% of this heat is carried by the helium and approximately 75% by the oil of the compressor. Usually either water or air is used to cool the hel[um and the oil.

Known compressors that are air-cooled have the disadvantage that they are relatively large. The ventilator, which is located in the compressor housing, generates air movements and dust whirls. Consequently, currently available air-cooled compressors are not useful in environments in which sensitive electronic supply-and measuring devices are located to perform low-temperature experiments. What is particularly disadvantageous is that these air-cooled compressors cannot be employed in dust-free "cleanrooms". The heat which is released into the room poses another significant problem, since the power of standard compressors for cryo-refrigerators usually is in the range of 3 to 7 KW. The heat generated by such compressors causes a considerable temperature increase in the room. This is undesirable particularly in the summer, and can also interfere with the operation of electronic devices.

SUMMARY OF THE INVENTION

The present invention relates to a compressor assembly for cryo-refrigerators where the coolers for both the operating oil of the compressor and the helium, as well as the ventilator, are accommodated in a housing separate from the compressor. The cooler for the helium is positioned upstream of the oil cooler with regard to the air current generated by the ventilator, and the compressor housing and the cooler housing are connected with each other via lines. Due to the location of the coolers in a separate housing, it is possible to provide a smaller compressor housing that can be incorporated into the same environment as sensitive electronic components. The connecting lines between the compressor and the refrigerator can be kept short, and the connecting lines between the compressor and the cooler/ventilator housing can be long, so that the housing can be arranged remote from the refrigerator. The remote placement of the cooler/ventilator housing is particularly advantageous when applied to a "clean room". Since a portion of the heat energy of the helium or oil to be cooled is already released as it passes through the connecting lines, relatively long connecting line's have the additional advantage of enhancing the effect of both coolers. Due to the fact that the cooler for the helium is placed upstream of the oil cooler, the entire air stream generated by the ventilator first passes over the helium cooler, whereby particularly effective cooling of the gas is achieved. The outlet temperature of the helium is usually approx. 5 to 8 degrees above the air intake temperature.

It is therefore an object of this invention to provide an air-cooled compressor assembly that isolates heat and air turbulence from sensitive locations.

It is another object of this invention to provide a compressor assembly where the compressor is connected to a cooler/ventilator housing using a plurality of flexible lines, preferably corrugated metal hoses, connected with self-sealing couplings.

It is a further object of this invention to provide a compressor assembly having as its ventilator, a cross-current fan approximately the same height as, and downstream of, the oil and helium cooler.

It is yet another object of this invention to provide a compressor assembly having a line carrying oil from the oil cooler, and another line carrying helium from the helium cooler, with the lines being connected together by a valved line and/or a capillary.

It is still yet another object of this invention to provide a compressor assembly having a housing, where the housing has one section for the helium cooler, one section for the oil cooler, and another section for the ventilator, where the cooler sections each has a bottom for inlet/outlet lines, a vert.ical pipe section around the cooler, and a reversing section at the top to allow the fluid to be cooler to flow between the bottom section and the cooler.

In attainment of the foregoing objects, the present invention contemplates an air-cooled compressor assembly for supplying helium to a cryo-refrigerator. The compressor assembly includes a compressor to supply compressed helium, a cooler for the helium, a cooler for the operating oil of the compressor, and a ventilator to provide a flowing airstream around the coolers. The coolers and the ventilator are located in a housing that is remote from the compressor, and the helium cooler is placed in the airstream, upstream of the oil cooler. Oil and helium flow between the housing and the compressor via a number of lines.

Other objects and advantages of the present invention will become apparent upon reference to the accompanying description when taken in conjunction with the following drawings.

DESCRIPTION OF THE PREFERRED EMBODIMENTS

Figure 1:
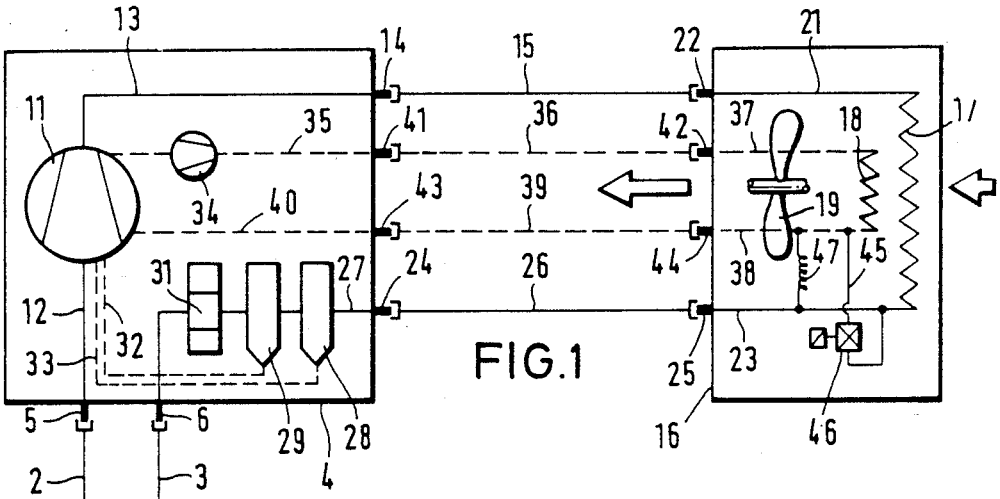
FIG. 1 is a schematic illustration of an air-cooled compressor assembly according to the present invention.

In FIG. 1, the refrigerator to be supplied with helium is represented by 1. It is connected with the compressor 4 by lines 2 and 3. The connecting lines 2, 3 are attached at the refrigerator 1 and the compressor housing 4 by self-sealing couplings 5–8.

Within the compressor housing 4, the compressor 11 is located. Line 12 connects the inlet of the compressor with the connecting line 2. The outlet of the compressor is connected to a line section 13, which leads to the self-sealing coupling 14 at the compressor housing 4. Following this is a line 15 which leads to the separate cooler/ventilator housing 16.

Inside the cooler/ventilator housing 16, the helium cooler 17, the oil cooler 18, and the ventilator 19 are located. Thc coolers are arranged such that the air stream generated by the ventilator 19 first contacts the helium cooler 17 and subsequently contacts the oil cooler 18.

Coupling 14 (which leads from the compressor outlet) is attached to line 15, which is in turn attached to the self-sealing coupling 22. Coupling 22 is connected to line 21, which leads to the inlet of helium cooler 17. Connected to the outlet of the helium cooler 17 is the line section 23, which leads back to compressor housing 4 via self-sealing couplings 24 and 25 an the line 26. Line section 27 extends from coupling 24, within the compressor housing 4, and is equipped with up to two oil separators 28 and 29 as well as with an adsorption filter 31. The end of line 27 is connected with coupling 6, which leads via line 3 to the inlet of the refrigerator 1.

In the above-described circuit, the expanded helium proceeds to the compressor and is compressed to the required pressure. Next, the compressed and warmed-up helium proceeds to the helium cooler, where it is cooled-off to the desired temperature of no warmer than 40° C., and proceeds back to the refrigerator. In the separators 28 and 29 as well as in the adsorber 31, oil impurities present in the helium are separated. Via the lines 32 and 33, the separated oil is resupplied to the compressor 11.

Operating oil for the compressor is circulated by a feed pump 34 located in the compressor housing 4 and connected to the line section 35. Oil circulates through line section 35, the lines 36 and 37, the oil cooler 18 as well as the line sections 38, 39 and 40. The line sections 35 and 40 are accommodated inside the compressor housing 4; the line sections 37 and 38 are located in the cooler housing 16. Self-sealing couplings 41 to 44 connect the lines 36 and 39 between the compressor housing 4 and the cooler housing 16. Some oil contamination of the helium is avoided by having separate circulation systems.

It is unavoidable that the helium gas has at least some contact with the operating oil while both fluids are passing through the compressor 11. Therefore, the gas leaving the compressor 11 contains some oil vapor. A significant portion of the oil vapor condenses within the cooler 17 and accumulates in liquid form. In order to be able to reintroduce this oil into the oil circulation system, the line sections 23 and 38 inside the cooler housing 16 are connected with each other via a valve 46 and a line 45 and/or via a capillary 47. In the event that a connecting line 45 with a valve 46 is employed, the valve 46 should be opened periodically. There is a substantial pressure difference between the two lines [oil lines have low pressure (approx. 7 bar), helium lines high pressure (approx. 22 bar)]. This pressure difference causes oil which has accumulated in the line section 2 to flow into the line section 38 of the oil circulation system. In the event that a capillary 47 is used, a continuous backflow of condensed oil into the oil circulation system is provided.

Figure 2:
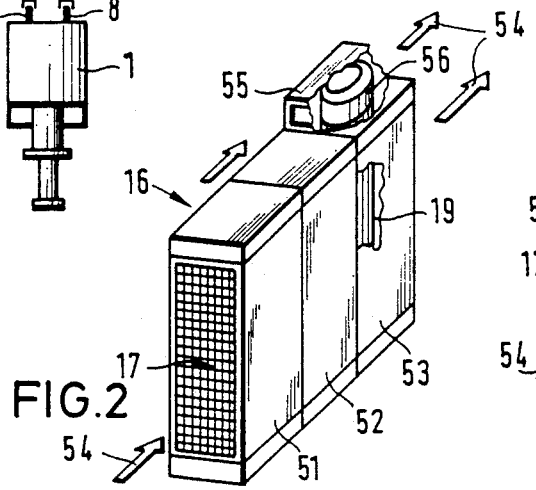
FIG. 2 is a perspective view partially broken away of the combined oil/helium cooler with cross current ventilator.

FIG. 2 shows a view of the cooler housing 16 with walls that are illustrated broken away in the area of the ventilator 19. Three housing sections 51, 52 and 53 are provided. The helium cooler 17 is located in the first section 51. The oil cooler 18 is located in the second section 52. The ventilatcr, in this case a cross current fan 19, is accommodated in a third section 53. The axial height of the ventilator is roughly equal to the height of the housing 16. The motor 56 of the ventilator 19 is located in top 55 of housing 16. In this embodiment it is possible to generate a strong air current which is basically uniformly distributed over the coolers 17 and 18.

Figure 3:
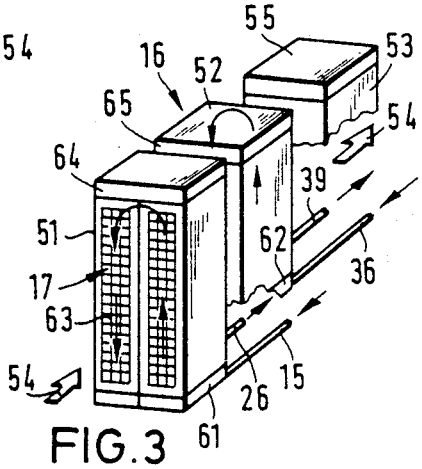
FIG. 3 is a perspective view, partially broken away of a compressor assembly of the present invention showing flow directions.

FIG. 3 reveals the manner in which the stream passes through the helium cooler 17 (in the housing section 51) and the oil cooler 18 (in the housing section 52). The lines (15, 36 or 26, 39) for the helium and oil are respectively connected at a bottom inlet/outlet section at the bottom of the housing sect:ions 51 and 52. The center regions of the housing sections 51, 52 are made up of vertically extending pipe sections 63 through which the oil or helium passes either from bottom to top or from top to bottom. Flow is connected between the coolers and the inlet/outlet sections in the top reversing sections 64 and 65. The air current generated by the fan 19 in the housing section 53 extends generally vertically.

Figure 4:
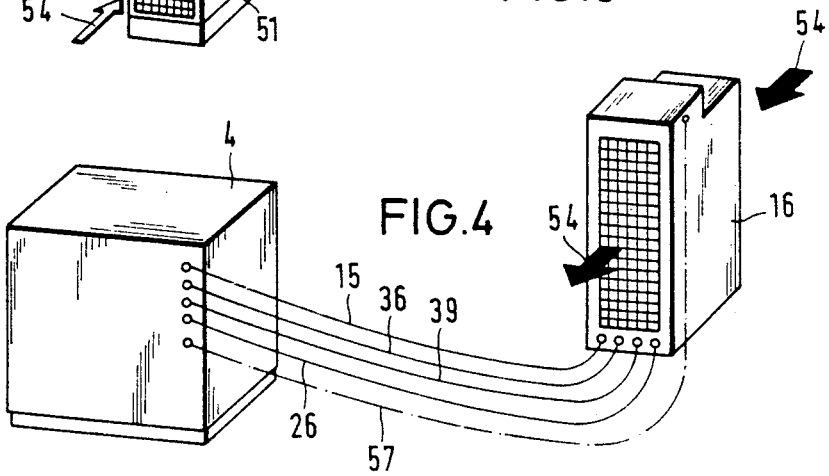
FIG. 4 is a perspective view of an air-cooled compressor assembly according to the present invention showing separate arrangement of the cooler.

FIG. 4 shows a view of the compressor housing 4, and of the cooler housing 16, connected by the lines 15, 26, 36 and 39 which are parallel to and spaced apart from each other. An electric supply line 57 is also provided. As mentioned earlier, the lines 15, 26, 36 and 39 are connected with the compressor housing 4 and the cooler housing 16 via self-sealing couplings. Preferably, they are made from flexible material so that the arrangement of the cooler 16 with regard to the compressor can be chosen to suit its particular operating environment. It: is particularly advantageous to use corrugated hoses made of metal (high grade steel) as connecting lines, which are kept at a distance using clamps. A portion of the heat carried by the helium and the oil can then be dissipated to the environment through the connecting lines.

Although this invention has been illustrated and described in connection with this particular embodiment, it will be apparent to those skilled in the art that various changes may be made therein without departing from the scope and spirit cf the invention as set forth in the appended claims.

I claim:

1. An air-cooled compressor assembly for supplying helium to a cryo-refrigerator, said compressor assembly comprising the following:

a compressor supplying compressed helium;

an oil circulation system supplying oeprating oil for said compressor;

a first cooler through which said compressed helium flows;

a second cooler through which said operating oil flows;

a first line carrying helium between said compressor and said first cooler;

a second line carrying oil betwen said oil circulation system and said second cooler; and means connected between said first line and said second line for returning condensed oil from said first line to said oil circulation system.

2. The compressor assembly of claim 1, further wherein said means connected between said first line and said second line comprises a valved line.

3. The compressor assembly of claim 1, further wherein said means connected between said first line and said second line comprises a capillary to allow oil condensed in said first cooler to flow continuously into said second line.

4. An air-cooled compressor assembly for supplying helium to a cryo-refrigerator, said compressor assembly comprising the following:

a compressor supplying compressed helium;

a first cooler through which said compressed helium flows;

a second cooler through which operating oil for said compressor flows;

means for ventilating said coolers;

a housing surrounding said ventilator and said coolers and spatially separated from said compressor, said housing including a plurality of sections;

a plurality of lines providing fluid communication between said housing and said compressor; and wherein each of said sections of said housing comprises a bottom inlet/outlet section communicating with at least two of said plurality of lines, a vertical pipe section encompassing the cooler, and a top reversing case facilitating fluid communication between teh cooler and the bottom inlet/outlet section.

5. An air-cooled compressor assembly for supplying helium to a cryo-refrigerator, said compressor assembly comprising the following:

a compressor supplying compressed helium;

a first cooler through which said comprssed helium flows;

a second cooler thorugh which operating oil for said compressor flows;

means for ventilating said coolers;

a housing surrounding said ventilator and said coolers and spatially separated from said compressor, said housing including a first section containing said first cooler; a second section containing said secoind cooler; and a third section containing said ventilating means;

wherein said housing and said compressor are in fluid communication with one another via a plurality of lines; and wherein each of said first and second sections of said housing comprises a bottom inlet/outlet section communicating with at least two of said plurality of lines, a vertical pipe section encompassing the cooler, and a top reversing case faclitating fluid communication between teh cooler and the bottom inlet/outlet section.

6. The compressor assembly of claim 5, further wherein said plurality of lines comprise flexible lines.

7. The compressor assembly of claim 6, further wherein said plurality of lines comprising flexible lines aer corrugated metal hoses.

8. The compressor assembly of claim 5, further wherein said plurality of lines are connected via self-sealing couplings.

9. The compressor assembly of claim 5, further wherein said ventilating means comprises a cross-current fan.

10. The compressor assembly of claim 9, further wherein said cross-curent fan is disposed downstream of said coolers with respect to said airstream, and wherein said coolers and said cross-current fan area of substantially the same axial height.

* * * * *